US008480505B2

(12) United States Patent
Huff

(10) Patent No.: US 8,480,505 B2
(45) Date of Patent: Jul. 9, 2013

(54) GOLF TRAINER

(76) Inventor: Christopher Huff, Waterloo, IA (US)

( * ) Notice: Subject to any disclaimer, the term of this patent is extended or adjusted under 35 U.S.C. 154(b) by 0 days.

(21) Appl. No.: 13/033,121

(22) Filed: Feb. 23, 2011

(65) Prior Publication Data

US 2011/0207545 A1 Aug. 25, 2011

Related U.S. Application Data

(60) Provisional application No. 61/307,957, filed on Feb. 25, 2010.

(51) Int. Cl.
*A63B 69/36* (2006.01)

(52) U.S. Cl.
USPC ..... 473/266; 473/274

(58) Field of Classification Search
USPC ..... 473/207, 208, 257, 266, 269, 271, 473/272, 273, 274, 275, 276
See application file for complete search history.

(56) References Cited

U.S. PATENT DOCUMENTS

| | | | | |
|---|---|---|---|---|
| 3,408,078 | A * | 10/1968 | Falerni et al. | 473/208 |
| 3,443,811 | A * | 5/1969 | Brooks | 473/274 |
| 3,510,135 | A * | 5/1970 | Gentile | 473/270 |
| 3,880,431 | A * | 4/1975 | Swanson | 473/139 |
| 5,286,028 | A | 2/1994 | Daugard | |
| 5,634,858 | A * | 6/1997 | Bellagamba | 473/257 |
| 5,762,565 | A | 6/1998 | Milam et al. | |
| 6,805,641 | B2 * | 10/2004 | Pope | 473/274 |
| 6,988,957 | B2 | 1/2006 | Bender | |
| 7,150,683 | B2 | 12/2006 | Bender | |

* cited by examiner

*Primary Examiner* — Nini Legesse
(74) *Attorney, Agent, or Firm* — Andrus, Sceales, Starke & Sawall LLP

(57) ABSTRACT

A golf swing monitoring and feedback system uses an adjustable support and foam ball that are variably positionable in contact with or closely spaced from a body part whose proper positioning is important in developing a proper swing. The support apparatus includes a main vertically adjustable tubular body, the lower end of which can be supported in a stand-up golf bag or can be pressed into the ground by the use of a spike on the lower end of the body.

6 Claims, 5 Drawing Sheets

GOLF TRAINER

CROSS REFERENCE TO RELATED APPLICATION

This application relates to and claims priority from U.S. Provisional Application Ser. No. 61/307,957 filed on Feb. 25, 2010.

BACKGROUND OF THE INVENTION

The present invention relates to a training apparatus and system for monitoring multiple aspects of a golf swing and providing feedback to the golfer. More particularly, a portable, adjustable, multi-positionable device can be easily assembled and disassembled and used on the course while playing or in practice.

Many devices have been developed to monitor head, arm, body, hip and leg movement of a golfer during the golf swing. These devices are generally specific to the feature being monitored and vary widely from one device to another in terms of the components of the device and the manner in which they are set and adjusted in use.

The subject invention and the system in which it is used were developed on the basis of providing a single golf swing monitoring device that can be adjusted to a very wide variety of positions to monitor position and movement of various body parts during the golf swing.

SUMMARY OF THE INVENTION

In accordance with one aspect of the invention, a portable, multi-position golf swing training apparatus includes a two-piece rigid tubular body that has an upper body portion telescopingly received in a larger diameter lower body portion for movable adjustment between a retracted position and an extended position, a flexible tubular neck demountably attached at one end to the upper end of the upper body portion, and a soft low density head attached to the other end of the neck. This is a basic embodiment of the present invention.

The apparatus preferably provides for demountable detachment of the head to the neck. The head preferably comprises a foam ball. A bore is provided to extend through the foam ball and a long machine screw extends through the bore and provides threaded connection to the end of the neck. The apparatus may also include a demountable spike attached to the lower end of the lower body portion, permitting the spike to be pushed into the ground to support the apparatus in use. The apparatus may also be supported by simply inserting the lower body portion into a self-standing or stand-up golf bag, thereby permitting use on the practice range or on the golf course.

The tubular body may have an outside diameter in the range of about 0.75 in. to about 1 in., and a length in the range of about 36 in. to about 64 in. The length may be adjusted as desired between these limits. The upper and lower body portions are preferably of approximately equal lengths.

The golf training apparatus of the present invention may be incorporated into a simple monitoring system that adapts it for use in play on the golf course and on the practice range. In one such embodiment, the apparatus includes an adjustable-length two-piece rigid tubular body having an upper body portion and a lower body portion, a flexible tubular neck attached at one end to the upper end of the upper body portion, a low density spherical head (such as a foam ball) attached to the other end of the neck, the lower end of the lower body portion shaped to be slidably inserted into and supported by a standing golf bag, and a spike attached to the free lower end of the lower body portion for insertion into the ground for use outside the golf bag. The upper body portion is preferably held in the lower body portion for sliding movement therein. Preferably, the neck is demountably attached to the upper end of the upper body portion. Also, the spherical head may be demountably attached to the neck. The spike may also be demountably attached to the lower end of the lower body portion.

In another embodiment of the invention, a steel plate is used to support the apparatus on the ground, instead of using an end spike. Between the supporting plate and the tubular body, a short flexible gooseneck piece is interconnected to allow the upper body portion of the apparatus deployed at an acute angle to the vertical. This simulates the positioning of the tubular body when placed in a standup golf bag.

DETAILED DESCRIPTION OF THE PREFERRED EMBODIMENT

Figure 1:
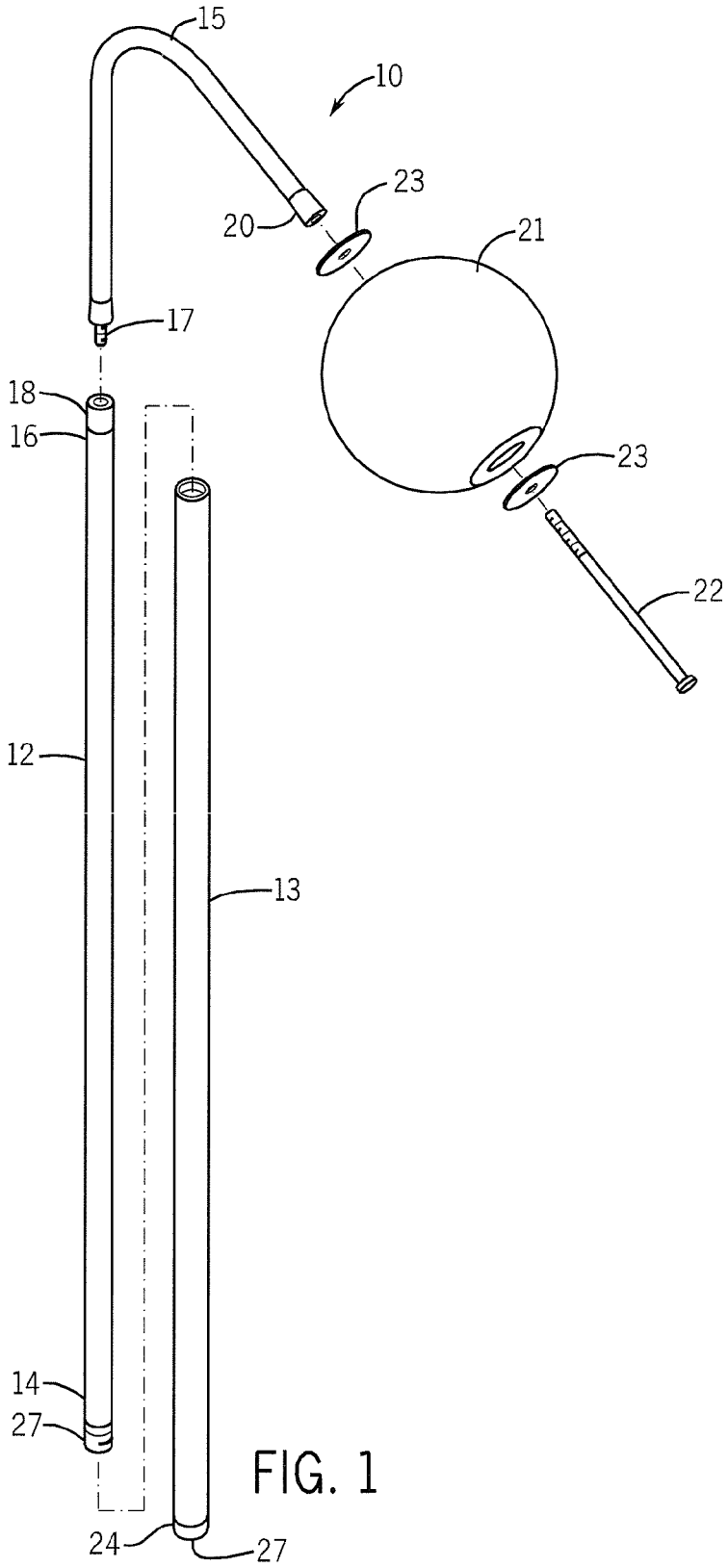
FIG. 1 is an exploded view of the components of the golf training device of the present invention.
Figure 2:
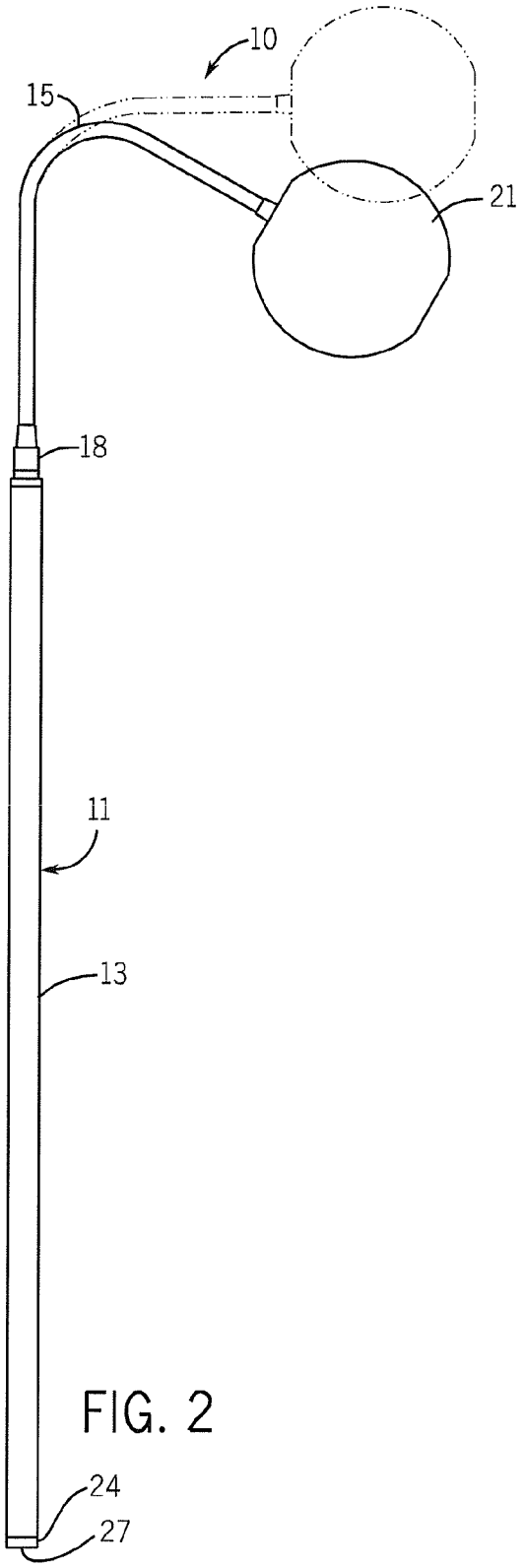
FIG. 2 is a side view of the apparatus of the present invention with the upper body portion telescoped into the lower body portion.
Figure 3:
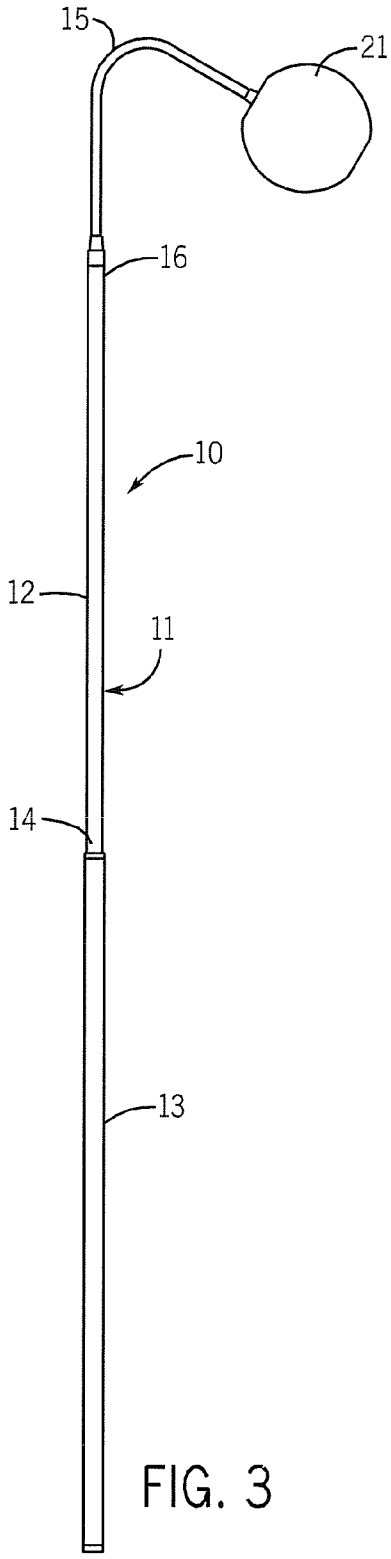
FIG. 3 is a side view similar to FIG. 2 showing the fully extended position of the upper tubular body portion.

FIG. 1 shows all of the components of the apparatus of the present invention in an exploded view. In FIG. 2, the apparatus is assembled, but the main body is collapsed to its shortened position. In FIG. 3, the body is extended to its full length. The portable multi-adjustable apparatus 10 of the present invention includes a two-piece rigid tubular body 11 including an upper body portion 12 and a lower body portion 13. The body portions 12 and 13 are preferably made from hollow aluminum tubing with the upper body portion 12 slightly smaller in outside diameter than the ID of the lower body portion 13, such that the former may be telescopically inserted into the latter. The lower end 14 of the upper body portion 12 is provided with an internal cam locking device such that the position of the upper body portion 12 within the lower body portion 13 may be set and held by rotation of the upper body portion with respect to the lower body portion and loosened for repositioning by opposite relative rotational movement. Each of the body portions 12 and 13 may have a length of about 36 in. and, when the upper body portion 12 is fully extended, the combined length of the two may be about 64 in.

Figure 4:
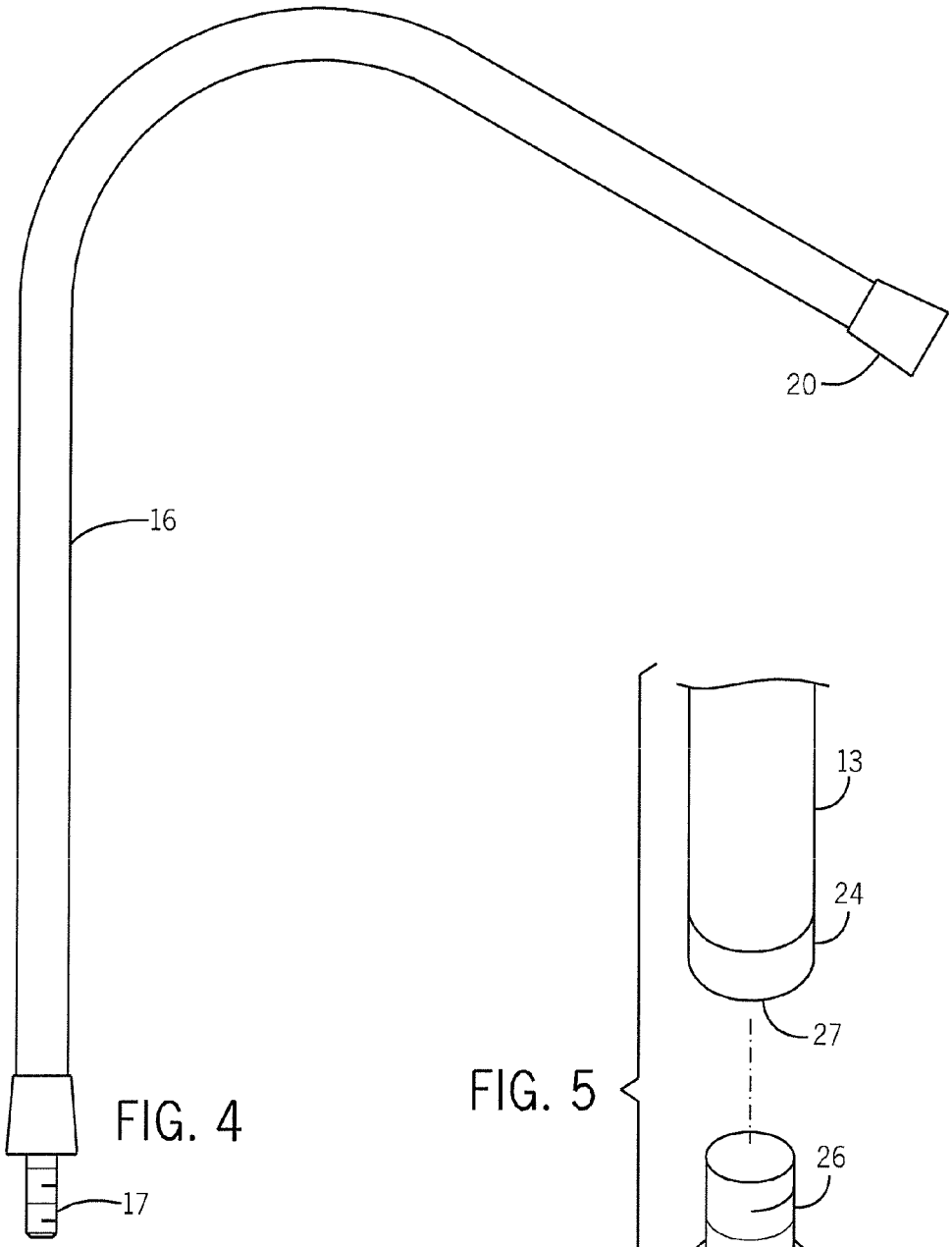
FIG. 4 is an enlarged detail of the flexible neck.

A flexible neck 15 is attached to the upper end 16 of the upper body portion 12. The neck may be of a typical "gooseneck" construction such as that used in a desk lamp. Referring also to FIG. 4, one end of the neck 15 is provided with a threaded stud 17 by which it may be demountably attached to a threaded ferrule 18 mounted in the upper end 16 of the upper body portion 12. The opposite end of the neck 15 is provided with a threaded ferrule 20.

A polymeric foam ball 21 is attached to the end of the neck with a long machine screw 22 extending through a bore in the foam ball and threaded into the ferrule 20. Suitable washers 23 on opposite ends of the bore through the foam ball 21 provide load distribution and bearing support for the machine screw/ball interface.

Figure 5:
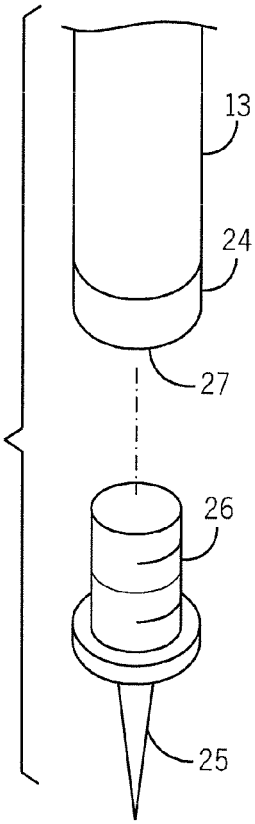
FIG. 5 is a broken away detail of the lower end of the lower body portion showing a demountable spike for holding the apparatus in position in use.
Figure 6:
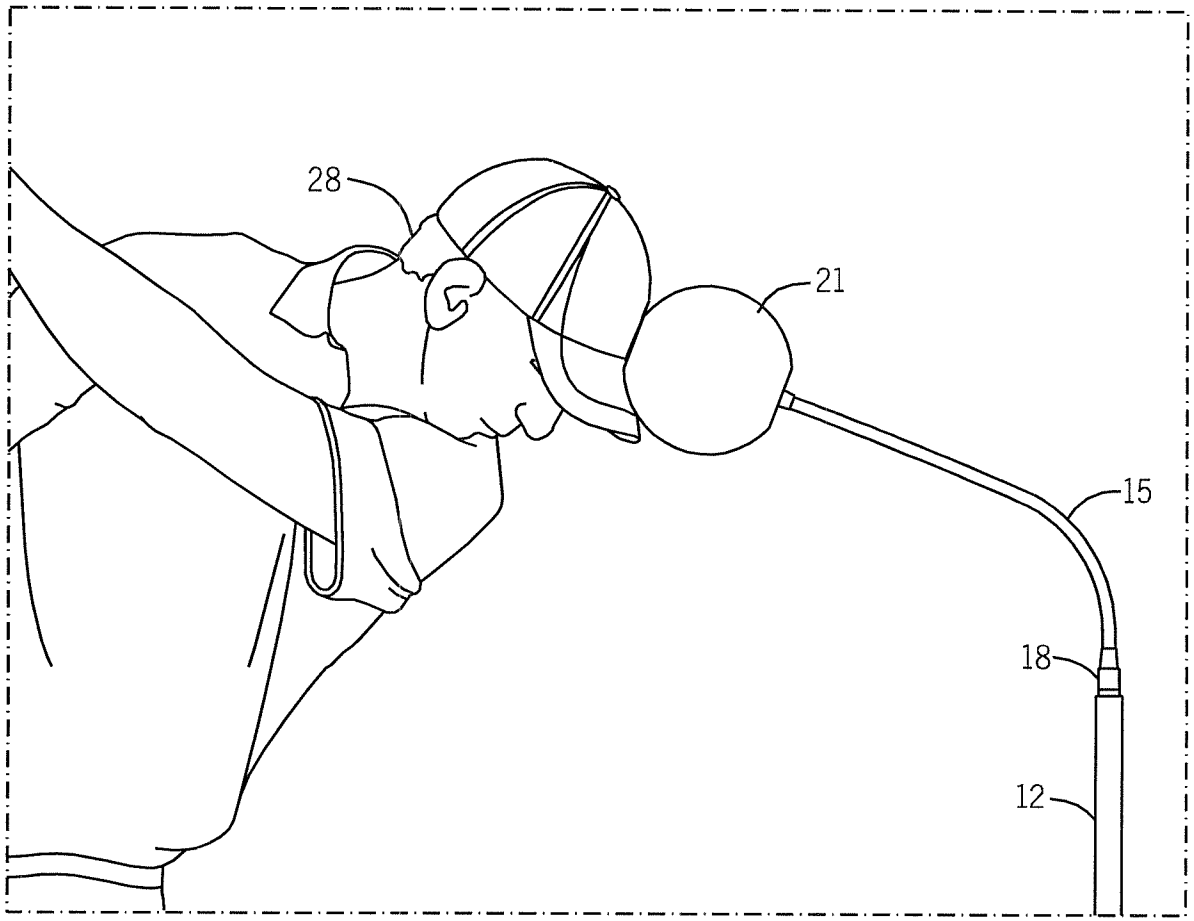
FIG. 6 shows the apparatus of the present invention in a position used to monitor golfer head movement during the swing.

The golf swing training apparatus 10, as shown in its collapsed position in FIG. 2 and its extended position in FIG. 3, must be supported, in use, by the lower end 24 of the lower body portion 13 and/or the lower body portion 13 itself. One such means of support is shown in FIG. 5 and comprises a spike 25 provided on one end with a threaded stud 26 adapted to be attached to a threaded ferrule 27 in the lower end 24 of the lower body portion 13. The spike 25 permits the apparatus to be pressed into the ground in a substantially vertical position or a position angled from the vertical. Alternately, as shown in FIG. 6 and to be discussed in greater detail below, the tubular body 11 may be simply inserted into a stand-up golf bag with or without attachment of the spike 25. The golf bag provides adequate support for the lightweight apparatus.

Referring again to FIGS. 2 and 6, the apparatus of the present invention is shown with the tubular body 11 extending from a stand-up golf bag and positioned to monitor head movement of the golfer 28. In this position, the main body 11 is tilted toward the golfer, the flexible gooseneck 15 is extended toward the golfer, the foam ball 21 is positioned at the height of the golfer's forehead and spaced slightly from the forehead when the golfer has assumed his stance and addressed the ball. If in either the backswing or the downswing the golfer's head touches the foam ball 21, he will realize his head has moved forward. With repeated swings, the feedback provided by contact with the foam ball will train the user to reduce or eliminate forward head movement.

In a similar fashion, the foam ball can be positioned near either side of the golfer's head to monitor and provide feedback resulting from undesirable lateral head movement.

The adjustability of the apparatus, particularly the telescoping body 11 and adjustable neck 15, permits the apparatus to be positioned to monitor and assist in correcting lower body movement or hip movement. In between, the adjustable positioning of the apparatus permits shoulder and arm movement to be monitored, as for example, hand path movement to monitor and help to keep the hands on the plane of the downswing and follow through, and many other swing movements and positions, all of which provide feedback to the golfer to correct undesirable movement and positioning.

A typical standup golf bag includes a pivotal stand that, when deployed, holds the bag at an acute angle to the vertical. This in turn permits the tubular body 11 of the present invention to also be deployed at approximately the same angle. This position is preferred to provide ample room for the golfer's swing when he is facing the training device head on. However, when the device is deployed outside a golf bag, using the end spike 25 shown in FIG. 5, the tubular body 11 must be deployed substantially vertically.

Figure 7:
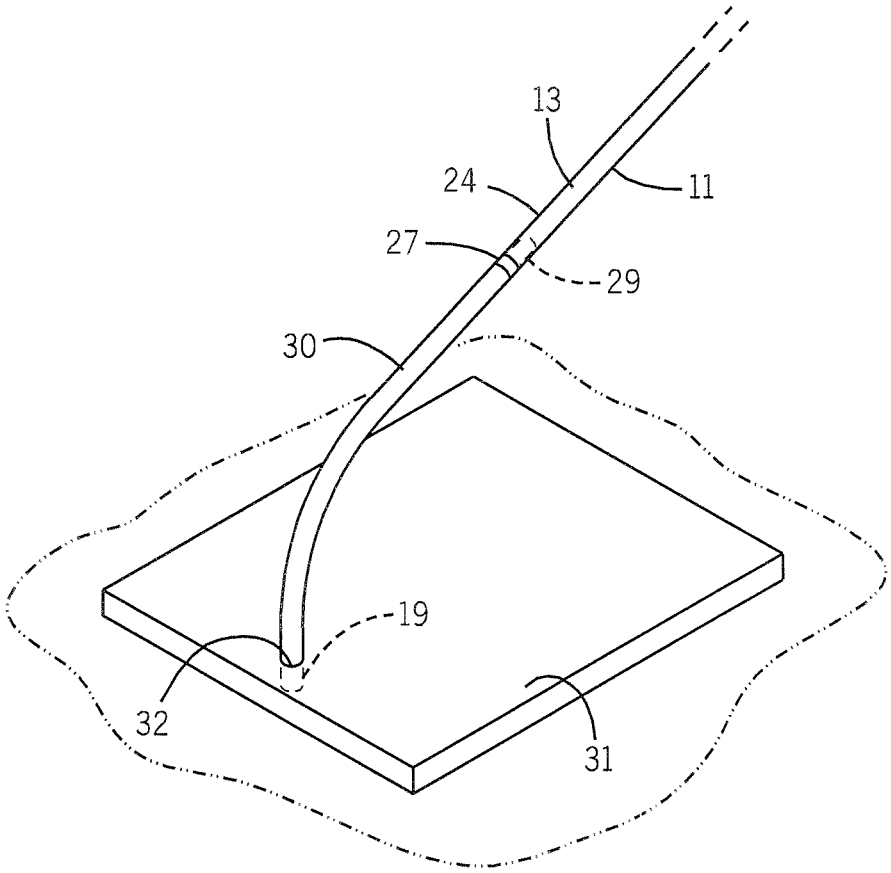
FIG. 7 is a perspective view of a supporting base and flexible connector as an alternate to support the apparatus on the ground.

In order to provide an angled position for the body 11, an alternate support arrangement is shown in FIG. 7. In this embodiment, a short flexible gooseneck piece 30 is used to demountably interconnect the lower body portion 13 and a supporting base 31. The base may conveniently comprise a rectangular steel plate having plan dimensions of 8 in.×10 in. and thickness of ⅜ in. A tapped hole 32 near one of the narrow edges of the base plate 31 is adapted to receive a threaded stud 19 on the lower end of the gooseneck piece 30. A similar threaded stud 29 on the opposite end of the gooseneck piece 30 is threadably attached to the lower end 24 of the lower body portion 13.

The flexible gooseneck piece 30 is substantially shorter in length than the upper flexible neck 15, which may be 18 in. in length. However, a short flexible piece 20 permits the tubular body 11 to be tilted to a selected acute angle with respect to the vertical to simulate the positioning of the device when used in a standup bag.

It is also believed that the apparatus of this invention can be used in a similar manner to monitor and provide feedback for body movement in a baseball or softball swing. For example, the monitoring of head position, as discussed above, could be most helpful to a batter. In addition, the apparatus of this invention could be adapted to be used to monitor body movements in other sports and in physical therapy applications.

The apparatus of the present invention is of relatively simple construction, can be easily taken apart and reassembled, and is lightweight. This single apparatus can replace complex multi-component systems and offers true portability permitting its use virtually anywhere. The simple positioning of the foam ball next to the path of certain body movements, e.g. arm, hand or club, or in contact with a body part whose movement is being monitored, e.g. head, shoulders, arms, hands and hips, can provide very valuable feedback and the rapid resolution of problems in a golf swing.

What is claimed is:

1. A portable multi-position non-intrusive golf swing training apparatus comprising:

a two-piece rigid tubular body having an upper body portion telescopingly received in a larger diameter lower body portion for slidable adjustment between a retracted position and an extended position;

a flexible tubular neck demountably attached at one end to an upper end of the upper body portion;

a low density foam head demountably attached to the end of the neck opposite said one end; and, the combination of the adjustment of the tubular body and the flexible tubular neck permits the low density foam head to be positioned closely adjacent, but spaced from, any golfer body part from the hips to the head and the movement of which body part is detected by user contact with the low density head during the swing; and wherein the head comprises a compressible and resilient polymeric foam ball demountably attached to the neck;

an axial bore extending through the foam ball;

support and bearing washers on opposite ends of the bore;

a machine screw extending through the bore and washers; and a threaded connection on the end of the neck for receipt of the threaded end of the screw, whereby the inherent compressibility and resilience of the foam hold the threaded connection against unthreading, but allow manual unthreading.

2. The apparatus as set forth in claim 1 comprising:

a selectively positionable locking device on a lower end of the upper body portion; and a cylindrical wall in an interior of the lower body portion adapted to slidably receive the locking device and the upper body portion.

3. The apparatus as set forth in claim 1 comprising a demountable spike attached to a lower end of the lower body portion to support the apparatus on the ground surface in use.

4. A portable multi-position non-contact golf swing training apparatus, the apparatus comprising:

a two-piece rigid tubular body having an upper body portion telescopingly received in a larger diameter lower body portion for slidable adjustment between a retracted position and an extended position;

a flexible tubular neck demountably attached at one end to an upper end of the upper body portion;

a low density polymeric foam head attached to the end of the neck opposite said one end;

the combination of the adjustment of the tubular body and the flexible tubular neck permits the low density head to be positioned closely adjacent, but spaced from, any golfer body part from the hips to the head and the movement of which body part is detected by user contact with the low density head during the swing; and a flexible link piece having a first demountable attachment at a lower link piece end to a supporting base and a second demountable attachment at an upper link piece end to a lower end of the lower body portion to enhance the adjustability and positioning of the apparatus.

5. The apparatus as set forth in claim 4 wherein the flexible link piece comprises a tubular gooseneck.

6. The apparatus as set forth in claim 4 wherein the supporting base comprises a flat steel plate and the first demountable attachment to the flexible link piece comprises a lower threaded connection.

* * * * *